US006415766B1

(12) United States Patent
Kanno et al.

(10) Patent No.: US 6,415,766 B1
(45) Date of Patent: Jul. 9, 2002

(54) ENGINE IDLE CONTROL SYSTEM

(75) Inventors: Isao Kanno; Yoshikazu Nakayasu, both of Shizuoka (JP)

(73) Assignee: Sanshin Kogyo Kabushiki Kaisha, Shizouka (JP)

( * ) Notice: Subject to any disclaimer, the term of this patent is extended or adjusted under 35 U.S.C. 154(b) by 0 days.

(21) Appl. No.: 09/494,395

(22) Filed: Jan. 31, 2000

(30) Foreign Application Priority Data

Jan. 29, 1999 (JP) ..... 11-022740
Apr. 21, 1999 (JP) ..... 11-113310

(51) Int. Cl.[7] ..... F02D 41/08
(52) U.S. Cl. ..... 123/339.19; 123/339.22; 123/339.23
(58) Field of Search ..... 123/339.13, 339.19, 123/339.22, 339.23, 339.25, 339.26, 339.27

(56) References Cited

U.S. PATENT DOCUMENTS 4,850,318 A 7/1989 Torigai et al.
5,476,426 A 12/1995 Nakamura et al.
5,665,025 A 9/1997 Katoh
5,715,793 A 2/1998 Motose
5,722,368 A * 3/1998 Sakai ..... 123/339.23
5,875,757 A * 3/1999 Mizuno ..... 123/339.23
6,014,954 A * 1/2000 Kleeman et al. ..... 123/339.13
6,079,389 A * 6/2000 Ono et al. ..... 123/352
6,098,591 A * 8/2000 Iwata ..... 123/339.11
6,109,986 A * 8/2000 Gaynor et al. ..... 123/336
6,119,653 A * 9/2000 Morikami ..... 123/339.23

* cited by examiner

*Primary Examiner*—Erick Solis
(74) *Attorney, Agent, or Firm*—Knobbe, Martens, Olson & Bear LLP

(57) ABSTRACT

An engine idle control system includes an improved construction for changing an aimed idle engine speed, which is preset by the manufacturer therein, in response to various needs of a user. The engine has a main passage having a throttle valve therein and a bypass passage arranged to bypass the throttle valve. The bypass passage supplies an idle air charge to a combustion chamber of the engine when the throttle valve is generally closed and has an adjusting valve therein for adjusting the idle air charge. A control device controls the adjusting valve to reduce a difference between an actual idle speed sensed by an engine speed sensor and an aimed idle speed preset in the control device. The control device includes means for changing the aimed idle speed.

30 Claims, 6 Drawing Sheets

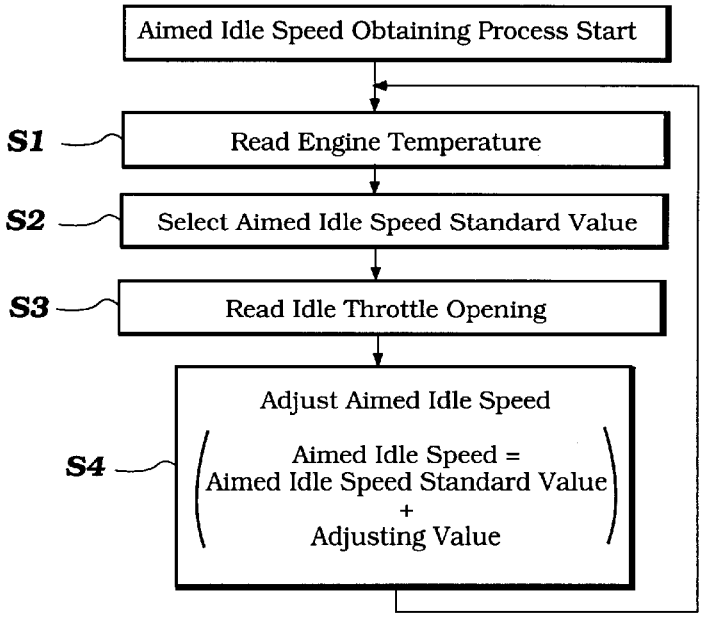
*Figure 4*
| Engine Temperature (°C) | -10 | 0 | 20 | 40 |
|---|---|---|---|---|
| Aimed Idle Speed Standard (rpm) | 900 | 800 | 750 | 700 |
*Figure 5*
| Idle Throttle Valve Opening | 0 | 0.3 | 0.5 | 1.0 |
|---|---|---|---|---|
| Adjusting Valve | -100 | -50 | ±0 | +50 |
*Figure 6*
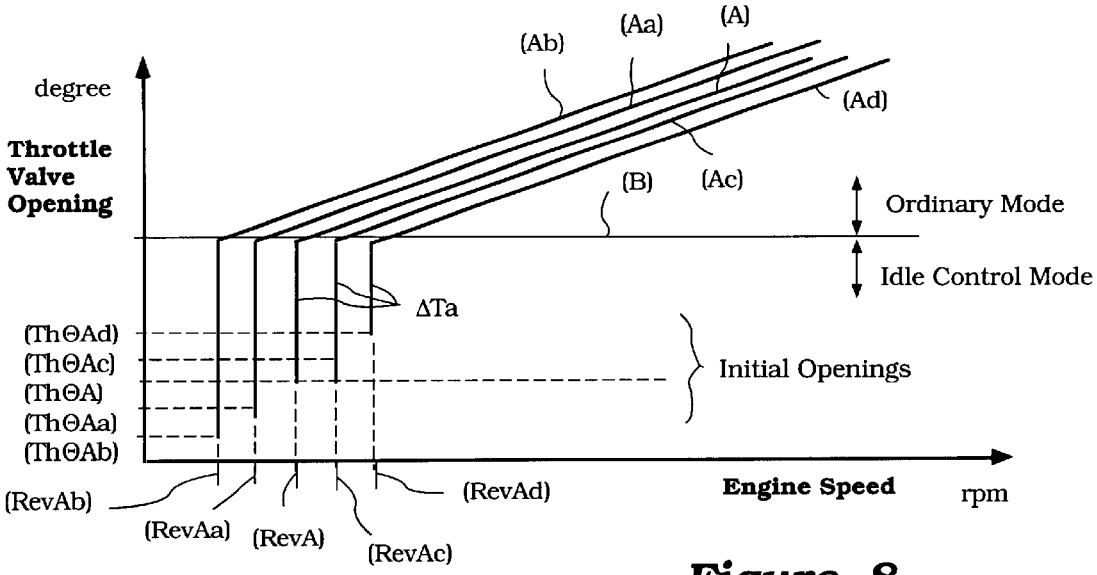
*Figure 8*

ENGINE IDLE CONTROL SYSTEM

The present application is based on and claims priority to Japanese Patent Application Nos. HEI 11-022740 and HEI 11-113310, which were filed on Jan. 29, 1999 and Apr. 21, 1999.

BACKGROUND OF THE INVENTION

1. Field of the Invention

This invention relates to an engine idle control, and more particularly to an improved idle control that is suitable for marine engines.

2. Description of Related Art

An engine has an air induction system to deliver an air charge to each combustion chamber of the engine. The air induction system may comprise a main passage in which a throttle valve is provided and an bypass passage that bypasses the throttle valve for supplying an idle air charge to the combustion chamber when the throttle valve is generally closed. In order to restraining fluctuations in idle engine speeds caused by dispersion of engine loads and also air charge amounts, conventionally the bypass passage is provided with a valve for adjusting an idle air charge passing therethrough. The adjusting valve is controlled by a control device based upon a difference between an actual idle speed and an aimed idle speed that is preset in the control device.

The engine can be incorporated in an outboard motor for propelling an associated watercraft. The watercraft is occasionally required to move forward in an extremely slow speed, i.e., a "trolling speed," for the occupant of the watercraft to fish. The trolling speed generally corresponds to an idle speed of the engine because it is obtained when a transmission is shifted to the forward position under the idle speed condition. However, some fishing techniques require the watercraft to move forward at a speed slower than the idle speed.

If the engine were not to be provided with the control device, it would be quite easy to decrease the idle speed. The occupant would only need to adjust an idle opening of the throttle valve so that a desired trolling speed is obtained. A control device of an engine, however, interferes with the closing operation of the throttle valve. That is, since the aimed idle engine speed is preset in the control device, even though the occupant adjusts the opening of the throttle valve, the control device precisely controls the adjusting valve in the bypass passage to meet with the aimed idle engine speed. As a result, the occupant cannot change the idle speed in response to the various usage inasmuch as a conventional idle speed control device which is not electronically controlled.

SUMMARY OF THE INVENTION

A need therefore exists for an improved idle speed control device that can change an aimed idle engine speed that is preset therein in response to various needs of an occupant or user.

In accordance with one aspect of the present invention, an internal combustion engine comprises a cylinder body defining at least one cylinder bore in which a piston reciprocates to rotate a cranks haft. A cylinder head is affixed to an end of the cylinder and defines a combustion chamber with the cylinder bore and the piston. An air induction system delivers an air charge to the combustion chamber. The air induction system includes a main passage having a throttle device therein and a bypass passage arranged to bypass the throttle valve for supplying an idle air charge to the combustion chamber when the throttle valve is generally closed. The bypass passage has an flow regulator therein to govern the idle air charge flow. A speed sensor is arranged to sense engine speed. A controller is connected to the speed sensor and to the flow regulator. The controller controls the flow regulator in the bypass passage to reduce a difference between the engine speed sensed by the speed sensor and an aimed idle speed that is preset in the controller. The controller also includes an idle adjuster to change the preset aimed idle speed.

In accordance with another aspect of the present invention, an idle control system is provided for an internal combustion engine. The engine has at least one combustion chamber. An air induction passage delivers an air charge to the combustion chamber. A bypass passage bypasses the air induction passage under the idle condition of the engine. The bypass passage includes means for adjusting an amount of the air charge passing therethrough. The idle speed control system comprises a speed sensor to sense an engine speed. Means are provided for controlling the adjusting means to reduce a difference between an actual engine speed sensed by the speed sensor and an aimed idle engine speed preset in the control system. Means are provided for changing the aimed idle engine speed.

In accordance with a further aspect of the present invention, a method of operating an internal combustion engine is provided. The engine has at least one combustion chamber. An air induction passage delivers an air charge to the combustion chamber. A bypass passage bypasses a portion of the air induction passage under the idle condition of the engine. The bypass passage includes a flow regulator to adjust an amount of the air charge passing therethrough. The method involves establishing an idle engine speed and sensing an actual engine speed. The flow regulator is controlled to reduce the difference between the actual engine speed and the aimed idle speed. The aimed idle speed is changed to vary the engine speed at idle in order to suit certain applications of the engine. For example, the engine speed can be lowered to a trolling speed wherein the engine is employed in an outboard motor.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 4 is a flowchart showing a control routine for determining an aimed idle engine speed.

FIG. 5 is a control map showing standard idle engine speeds corresponding to selected engine temperatures.

FIG. 6 is a control map showing aimed idle engine speeds corresponding to selected idle throttle openings.

FIG. 8 is a graphical view illustrating relationships between the aimed idle engine speeds and the selected idle throttle openings. The graph also illustrates the control map shown in FIG. 6 in another form and in more detail.

DETAILED DESCRIPTION OF THE PREFERRED EMBODIMENTS OF THE INVENTION

Figure 1:
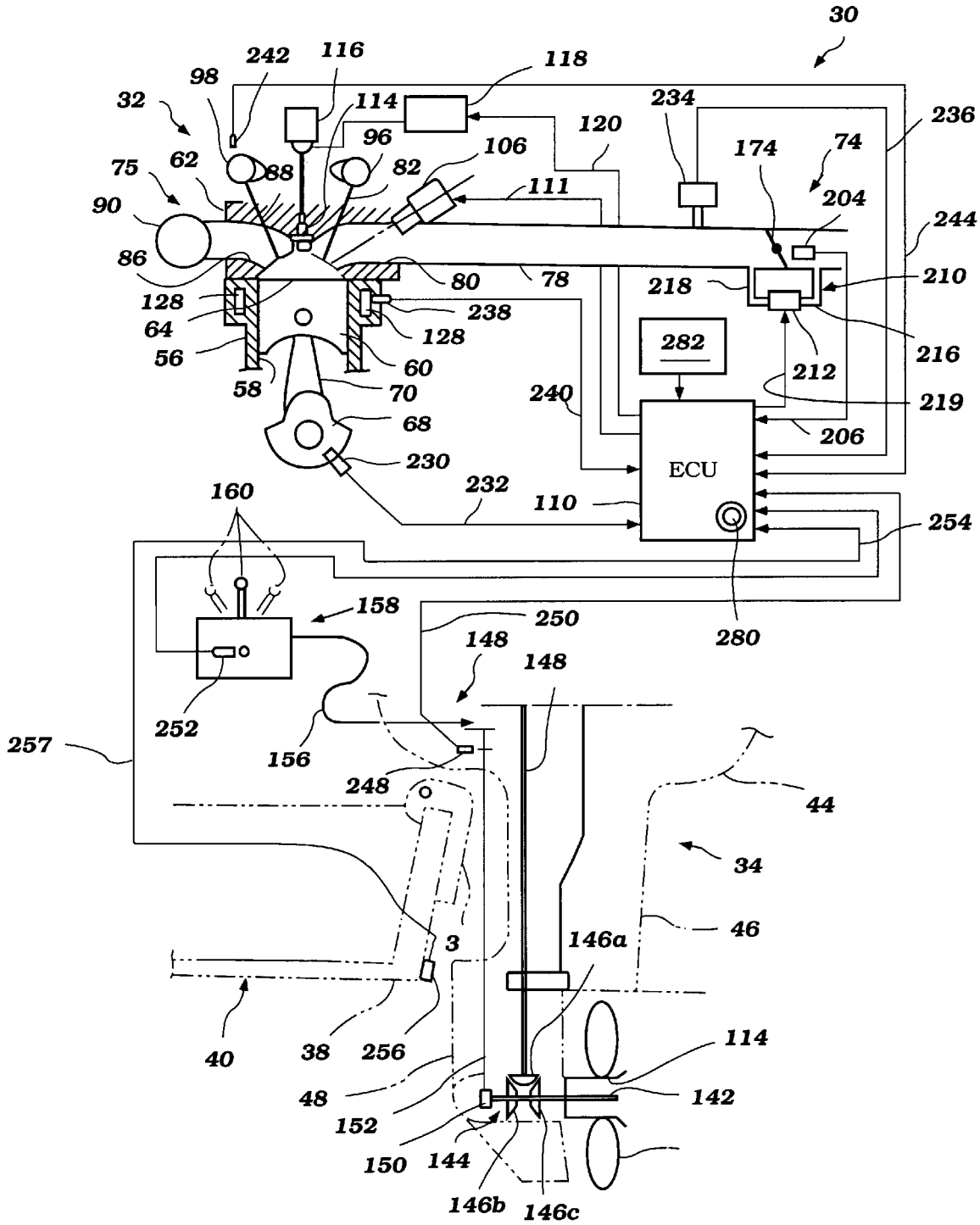
FIG. 1 is a schematic view showing an outboard motor in accordance with a preferred embodiment of the present invention. An engine, in part, and a control device are shown in the upper half view of the figure. The outboard motor, in part, with a transmission, a shift device of the transmission and an associated watercraft are shown in the lower half view of the figure. An EMU (Engine Control Unit) for the motor links together the two sections of the figure. The outboard motor and the associated watercraft are partially illustrated in phantom.
Figure 2:
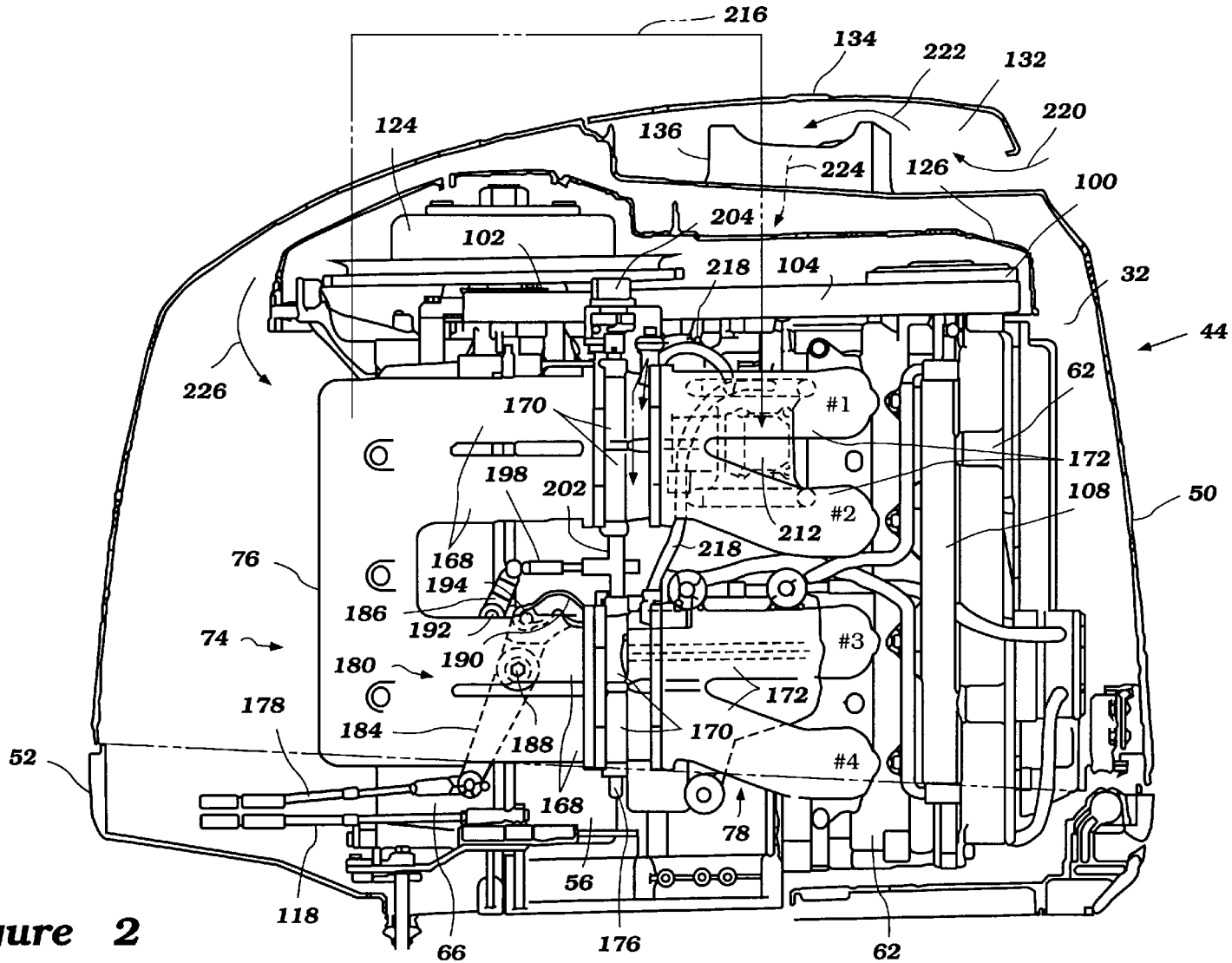
FIG. 2 is an elevational side view showing the actual outboard motor, particularly its power head incorporating the engine. Top and bottom protective cowlings are sectioned.
Figure 3:
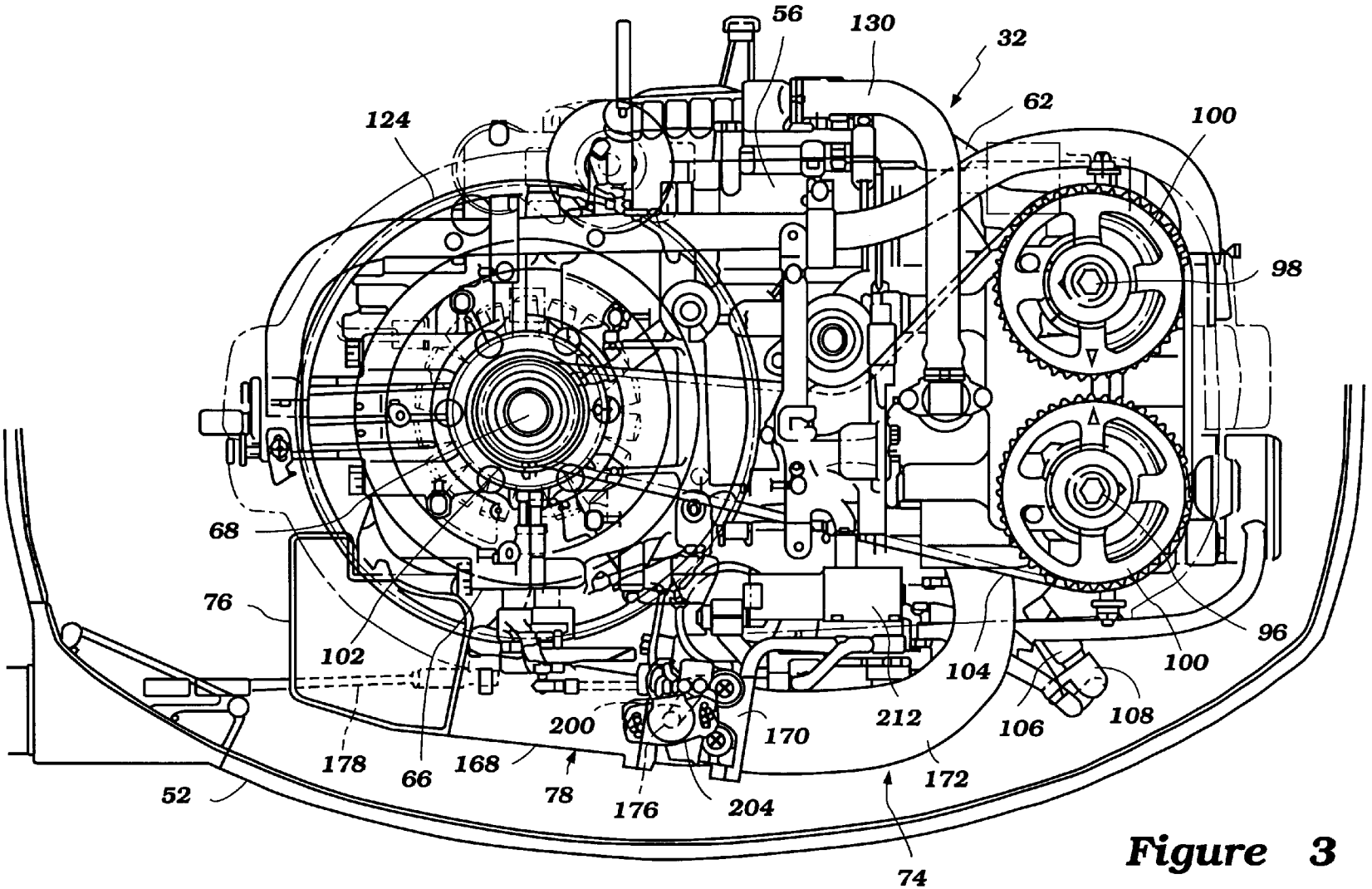
FIG. 3 is a top plan view showing the motor and engine of FIG. 2. The top protective cowling is removed and half of the bottom cowling is omitted.

With reference to FIGS. 1 to 3, an outboard motor, designated generally by the reference numeral 30, includes an internal combustion engine 32 arranged in accordance with a preferred embodiment of the present invention. Although the present invention is shown in the context of an engine for an outboard motor, various aspects and features of the present invention also can be employed with engines for other types of marine outboard drive units (e.g., a stem drive unit) and also, for example, for land vehicles.

In the illustrated embodiment, the outboard motor 30 comprises a drive unit 34 and a bracket assembly 36. Although schematically shown in FIG. 1, the bracket assembly 36 is actually comprises a swivel bracket and a clamping bracket. The swivel bracket supports the drive unit 34 for pivotal movement about a generally vertically extending steering axis. The clamping bracket, in turn, is affixed to a transom 38 of an associated watercraft 40 and supports the swivel bracket for pivotal movement about a generally horizontally extending axis. Since these types of constructions are well known in the art, further description of them is not believed to be necessary to permit those skilled in the art to practice the invention.

As used through this description, the terms "forward" and "front" mean at or to the side where the bracket assembly 36 is located, and the terms "rear," "reverse" and "rearwardly" mean at or to the opposite side of the front side, unless indicated otherwise.

The drive unit 34 includes a power head 44, a driveshaft housing 46 and a lower unit 48. The power head is disposed atop of the drive unit 34 and includes the engine 32, a top protective cowling 50 and a bottom protective cowling 52 (see FIG. 2).

As seen in the upper view in FIG. 1, and in FIGS. 2 and 3, the engine 32 operates on a four stroke cycle principle and powers a propulsion device. This type of engine is merely exemplary. The present idle control system can be used with engines having other cylinder configuration, having other number of cylinder and operating an other combustion principles (e.g., two-stroke crankcase combustion).

The engine 32 has a cylinder body 56 that defines four cylinder bores 58. The cylinder bores 58 are generally horizontally extending and are spaced generally vertically apart from each other. A piston 60 can reciprocate in each cylinder bore 58. A cylinder head assembly 62 is affixed to one end of the cylinder body 56 and defines four combustion chambers 64 with the pistons 60 and the cylinder bores 58. The other end of the cylinder body 56 is closed by a crankcase member 66 defining a crankcase chamber with the cylinder bores 58.

A crankshaft 68 extends generally vertically through the crankcase chamber. The crankshaft 68 is pivotally connected with the pistons 60 by connecting rods 70 and rotates with the reciprocal movement of the pistons 60. The crankcase member 66 is located at the forward-most end of the engine 32, then the cylinder body 56 and the cylinder head assembly 62 extend rearwardly from the crankcase member 66 one after the other.

The engine 32 includes an air induction system 74 and an exhaust system 75. The air induction system 74 is arranged to supply air charges to the combustion chambers 64 and comprises a plenum chamber 76, four main air intake passages 78 (see FIG. 2) and four intake ports 80. The intake ports 80 are defined in the cylinder head assembly 62 and are opened or closed by intake valves 82. When the intake ports 80 are opened, the air intake passages 78 communicate with the combustion chambers 64. The air induction system 74 will be described in greater detail below.

The exhaust system 75 is arranged to discharge burnt charges or exhaust gasses outside of the outboard motor 30 from the combustion chambers 56. Exhaust ports 86 are also defined in the cylinder head assembly 62 and are opened or closed by exhaust valves 88. When the exhaust ports 86 are opened, the combustion chambers 64 communicate with an exhaust manifold 90 that collects exhaust gasses and guides them downstream with the exhaust system 75. The exhaust gasses, in major part, are discharged to the body of water surrounding the outboard motor 30 through exhaust passages formed in the driveshaft housing 46 and lower unit 48 in a manner well known in the art.

An intake camshaft 96 and an exhaust camshaft 98 both extend generally vertically to activate the intake valves 82 and the exhaust valves 88, respectively. These camshafts 96, 98 have cam lobes thereon to push the intake valves 82 and the exhaust valves 88 at certain timings to open or close the respective ports 80, 86.

The camshafts 96, 98 are journaled on the cylinder head assembly 62 and are driven by the crankshaft 68. As best seen in FIG. 3, the respective camshafts 96, 98 have cogged pulleys 100 thereon, while the crankshaft 68 also has a cogged pulley 102 thereon. A cogged belt or chain 104 is wound around the cogged pulleys 100, 102. With rotation of the cranks haft 68, the camshafts 96, 98 also rotate.

In the illustrated embodiment, the engine 32 has a fuel injection system; however, various aspects of the present invention can be used with engines using other types of charge formers, such as, for example, carburetors. The fuel injection system includes four fuel injectors 106 and fuel delivery conduits 108. A fuel supply tank (not shown) is placed in the hull of the associated watercraft 40. The fuel contained in the fuel supply tank is supplied to low pressure fuel pumps and a high pressure fuel pump both placed on the outboard motor 30 to be pressurized by them. The pressurized fuel is, then, delivered through the delivery conduits 108 to the fuel injectors 106. The fuel is sprayed into the intake ports 80 every compression stroke during each cycle at a proper timing and then enters the combustion chambers 64 with an air charge when the intake valves 82 are opened. The injection timings are controlled by an engine control unit (EMU) 110, which is electrically operated, through a signal line 111. The EMU 110 will be described later in more detail.

The engine 32 further has a firing system. A spark plugs 114 is exposed into each combustion chambers 64 and is fired to ignite an air fuel charge at each preset timing during each cycle. For this purpose, the firing system has an ignition coil 116 and igniter 118 which are connected to the EMU 110 through a signal line 120 so that the firing timings are also controlled by the EMU 110.

The air fuel charges are formed with an air charge supplied by the main air intake passages 78 and fuel charges sprayed by the fuel injectors 106. While the illustrated engine uses an indirect injection system to inject the fuel charge into the induction path, the present control system can be used with a direct fuel injection system.

As seen in FIGS. 2 and 3, a flywheel assembly 124 is affixed atop of the crankshaft 68. The flywheel assembly 124 includes a generator to supply electric power to the firing system, the EMU 110, a battery, and other electrical equipment of the outboard motor and/or the watercraft. The outboard motor can, in addition or in the alternative, employ a generator for this purpose. A cover member 126 covers the flywheel assembly 124, pulleys 100, 102 and the belt 104 for protection of the operator or occupant of the watercraft 40 from such moving parts when the top cowling 50 is detached.

Additionally, the engine 32 has a cooling system for cooling heated portions of the engine such as the cylinder body 56 and the cylinder head assembly 62. In the illustrated embodiment, a water jacket 128 is shown in FIG. 1 as provided in the cylinder block 56. A water discharge pipe 130 (see FIG. 3) is also provided and the cooling water is discharged outside of the outboard motor 30 through the discharge pipe 130.

The top and bottom cowlings 50, 52 generally completely enclose the engine 32. The top cowling 50 is detachably affixed to the bottom cowling 52 so that the operator can access to the engine 32 for maintenance or other purposes. As seen in FIG. 2, the top cowling 50 defines a pair of air intake compartments 132 with compartment members 134 and recesses at both rear sides thereof. Each air intake compartment 132 has an air duct 136 that stands in the compartment 132. The air intake compartments 132 communicate with the interior of the protective cowlings 50, 52 through the air ducts 136.

As seen in the lower half view in FIG. 1, the driveshaft housing 46 depends from the power head 44 and supports a driveshaft 140 which is driven by the cranks haft 68 of the engine 32. The driveshaft 140 extends generally vertically through the driveshaft housing 46. The driveshaft housing 46 also defines internal passages which form portions of the exhaust system 75.

The lower unit 48 depends from the driveshaft housing 46 and supports a propeller shaft 142 which is driven by the driveshaft 140. The propeller shaft 142 extends generally horizontally through the lower unit 48. In the illustrated embodiment, the propulsion device includes a propeller 143 that is affixed to an outer end of the propeller shaft 142 and is driven thereby. A transmission 144 is provided between the driveshaft 140 and the propeller shaft 142. The transmission 144 couples together the two shafts 140, 142 which lie generally normal to each other (i.e., at a 90° shaft angle) with bevel gears 146*a*, 146*b*, 146*c*.

The outboard motor 30 has a switchover mechanism 148 of the transmission 144 to shift rotational directions of the propeller 143 between forward, neutral and reverse. The switchover mechanism 148 includes a shift cam 150, a shift rod 152 and a shift cable 156. The shift rod 152 extends generally vertically through the driveshaft housing 46 and lower unit 48, while the shift cable 156 is disposed in the lower protective cowling 52. The shift cable 156 extends outwardly from the lower cowling 52 and is connected to a remote shift operator 158 which is located near a steering handle in the associated watercraft 40. The shift operator 158 is provided with a shift lever 160 so as to be operated by the user. The switchover mechanism 148 is operable at certain engine speeds less than a predetermined speed.

The lower unit 48 also defines an internal passage that forms a discharge section of the exhaust system 75. At engine speed above idle, the majority of the exhaust gasses are discharged to the body of water surrounding the outboard motor 30 through the internal passage and finally through a hub 164 of the propeller 143 in a manner well known in the art.

Still with reference to FIGS. 1 to 3, the air induction system 74 will now be described in more detail. The plenum chamber 76 in the illustrated embodiment is positioned on the port side of the crankcase member 66. The main air intake passages 78 extend rearwardly from the plenum chamber 76 along the cylinder body 56 and then curved toward the intake ports 80. The plenum chamber 76 has an inlet opening, although it is not shown, at its front side and the plenum chamber 76 functions as an intake silencer and/or a coordinator of air charges. The air intake passages 78 are actually defined by duct sections 168 which are uniformly formed with the plenum chamber 76, throttle bodies 170 and runners 172. The upper two throttle bodies 170 are unified with each other. The upper, two runners 172 are also uniformly formed with each other at their fore portions and then forked into two rear portions. The lower, two throttle bodies 170 and runners 172 have the same constructions as the upper two throttle bodies 170 and runners 172. The air intake passages 78 comprising these members 168, 170, 172 extend generally horizontally along the respective cylinder bores 58 and are spaced generally vertically with each other. As indicated in FIG. 2, the air intake passages 78 are numbered as #1 through #4 from the top to the bottom to aid description.

The respective throttle bodies 170 support throttle devices (e.g., butterfly-type throttle valves) 174. In the illustrated embodiment, the throttle valves 174 are supported within the respective throttle bodies 170 for pivotal movement about axes of valve shafts extending generally vertically. The valve shafts are linked together to form a single valve shaft 176 that passes through the entire throttle bodies 170. The throttle valves 174 are operable by the operator through a throttle cable 178 and a non-linear control mechanism 180.

The non-linear control mechanism 180 includes a first lever 184 and a second lever 186 joined together with each other by a cam connection. The first lever 184 is pivotally connected to the throttle cable 178 and pivotally connected to a first pin 188 which is affixed to the cylinder body 56. The first lever 184 has a cam slot 190 at the end opposite of the connection with the throttle cable 178. The second lever 186 is generally shaped as the letter "L" and is pivotally connected to a second pin 192 which is affixed to the crankcase member 66. The second lever 186 has a pin 194 that fits and slides within the cam slot 190. The other end of the second lever 186 is pivotally connected to a control rod 198. The control rod 198, in turn, is pivotally connected to a lever member 200 (FIG. 3). The lever member 200 is, then, connected to the throttle valve shaft 176 via a torsion spring 202 that urges the control rod 198 to a position shown in FIG. 2. At this position of the control rod 198, the throttle valve shaft 176 is in a closed position wherein almost no air charge can pass through the air intake passages 78.

When the throttle cable 178 is operated, the first lever 184 pivots counter-clockwise in FIG. 2 about the first pin 188. The second lever 186, then, pivots about the second pin 192 in a clockwise direction. Since the pin 194 of the second lever 186 is fitted in the cam slot 190, the second lever 186 rotates in a non-linear manner with respect to the rotation of the first lever 184 in accordance with a relationship defined by the cam shape. Then, the second lever 186 pushes the control rod 198 against the biasing force of the torsion spring 202 to open the throttle valves 174. When the throttle cable 178 is released, the control rod 198 returns to the initial position by the biasing force of the spring 202 and the throttle valves 174 are closed again.

A throttle valve position sensor 204 is placed atop of the throttle valve shaft 176. A signal from the position sensor 204 is sent to the EMU 110 through a signal line 206 for the idle speed control, fuel injection control and other engine controls.

The air induction system 74 further includes a bypass passage or idle air supply passage, which is generally identified by the reference numeral 210 (FIG. 1), that bypasses the throttle valves 174. An idle air adjusting unit 212, which incorporates a throttle device, such as, for example, a butterfly valve, is provided in the bypass passage 210. The valve provided in the idle air supply unit, as well as the throttle valves, are not limited to the butterfly type valve and, for example, a needle type or gate type valve can be used. Other types of throttle devices can additionally be used in place of the butterfly valve.

In the illustrated embodiment, the idle air adjusting unit 212 is located between the cylinder body 56 and the main air intake passages 78 and is affixed to the #1 and #2 runners 172. This is effective because the heat in the cylinder body 56 does not conducted to the idle air adjusting unit 212. An inlet bypass 216, which is shown schematically with the phantom line in FIG. 2, connects the plenum chamber 76 with the adjusting unit 212. A pair of outlet bypasses 218 connect the adjusting unit 212 with bypass inlet ports which are positioned on the #1 throttle body 170 and #3 throttle body 170 downstream of the throttle valves 174. Each inlet port also communicates with the other induction passage that is unified at this point along the induction path. That is, the passage through the #2 throttle body also communicates with the inlet port on the #1 throttle body (as schematically represented in FIG. 2) and the passage through the #4 throttle body also communicates with the inlet port on the #3 throttle body.

An opening degree of the valve in the idle air adjusting unit 212 is controlled by the EMU 110 through a signal line 219. This control will be described in more detail shortly.

Air is introduced, at first, into the air intake compartments 132, as indicated by the arrow 220, and enters the interior of the top cowling 50 through the air ducts 136, as indicated by the arrows 222, 224. Then, the air goes down to the inlet opening of the plenum chamber 76, as indicated by the arrow 226, and enters the plenum chamber 76. The plenum chamber 76 attenuates intake noise and delivers air charges to the respective duct sections 168.

Under running conditions above idle, an air charge amount is controlled by the throttle valves 174 to meet the requirement of the engine 32. The regulated air charge then flows through to the respective runner 172 and reaches the intake ports 80. As described above, the intake valves 82 are provided at these intake ports 80. Since the intake valves 82 are opened intermittently by the cam lobes of the intake camshaft 96, the air charge is supplied to the combustion chambers 64 when the intake valves 82 are opened.

Under the idle running condition, the throttle valves 174 are generally closed, although a very small opening is still ensured in this condition. Air also goes to the idle air adjusting unit 212 in the bypass passage 210. The EMU varies the opening degree of the valve in the unit 212 in a manner corresponding to the opening of the throttle valves 174 and in response to fluctuations in an engine load and an air charge amount passing through the throttle valves 174. The idle air charge adjusted in the idle air adjusting unit 212, then, returns to the main passages 78, i.e., to the runners 172 and supplied to each of the combustion chambers 64 as well.

With reference to FIGS. 1 and 4 to 8, the EMU 110 and its control will now be described. The EMU 110 controls the engine operations, particularly, the fuel injection system and ignition system, as well as the idle speed control system, which includes the idle air adjusting unit 212, with various control maps stored memory in the EMU 110. In order to determine appropriate control indexes in the maps or calculate them based upon the control indexes determined in the maps, various sensors other than the throttle valve position sensor 204 are provided for sensing engine conditions and other environmental conditions.

There is provided, associated with the crankshaft 68, a cranks haft angle position sensor 230 which, when measuring crankshaft angle versus time, outputs a cranks haft rotational speed signal or engine speed signal that is sent to the EMU 110 through a signal line 232.

An intake air pressure sensor 234 is provided that senses air pressure in one of the main air passages 78. The sensed signal is sent to the EMU 110 through a signal line 236. This signal can be used for determining an engine load.

A water temperature sensor 238 which outputs a cooling water temperature signal to the EMU 110 through a signal line 240 is provided at the water jacket 128.

A cylinder discrimination sensor 242 is also provided to sense a rotational angle of the exhaust camshaft 98. The sensed signal is transmitted to the EMU 110 through a signal line 244.

Also, there is provided a shift position sensor 248 that sends a signal indicating a position of the shift rod 152 (forward, neutral or reverse) to the EMU 110 through a signal line 250.

A lever operational speed sensor 252 is provided to sense a rotational speed of the shift lever 160 and its signal is sent to the EMU 110 through a signal line 254.

A watercraft velocity sensor 256 is further provided at the lowermost portion of the transom 38 and sends a signal to the EMU 110 through a signal line 257.

These sensors are well known and any one of such conventional sensors is applicable. Thus, further descriptions on them are not believed to be necessary.

The EMU 110 seeks for an aimed idle engine speed in maps which are stored in the EMU 110 based upon the sensed conditions or calculates out an appropriate idle speed by using the numerical values in the map. FIG. 4 illustrates this control routine and FIGS. 5 and 6 illustrate maps applied in the routine.

In the illustrated embodiment, an opening of the throttle valves 174 in idle is adjustable by an adjusting screw (not shown) and an initial opening is selected at, for example, 0.5 degrees in the control map shown in FIG. 5 when the outboard motor 30 is shipped out from a factory. The user or operator of the motor 30 may select other initial openings such as, for example, 0.0, 0.3 or 1.0 degrees at will using the adjusting screw. In In FIG. 4, the control routine starts and moves to the step S1 to read the engine temperature by means of the signal sensed by the water temperature sensor 238. The routine, then, goes to the step S2 to select a standard value of the aimed idle speed corresponding to the sensed temperature from the map shown in FIG. 5. If no temperature in the control map meets with the temperature, the EMU 110 calculates the nearest value with an appropriate conventional calculation method to adjust it to the actual temperature. Next, the routine goes to the step S3 to read an opening of the throttle valves 174 by means of the signal sensed by the throttle valve position sensor 204. The routine, then, moves to the step S4 to calculates an adjusted idle speed based upon the adjusting value corresponding to the throttle opening in the control map shown in FIG. 6. That is, the adjusted idle speed is obtained by adding the adjusting value to the standard value of the aimed idle speed. For instance, if the engine temperature is 40° C. and the throttle valve opening is 0.3 degrees, the aimed idle speed will be calculated as 650 rpm (=700 rpm −50 rpm).

In the control routine, the step S3 may precede the step S1. In fact, the step S1 can be even omitted if the standard value of the aimed idle speed is previously fixed. If the step S1 is omitted, the step S2 is also omitted accordingly and the previously fixed standard value is applied for the control irrespective of the temperature of the engine 32.

Figure 7:
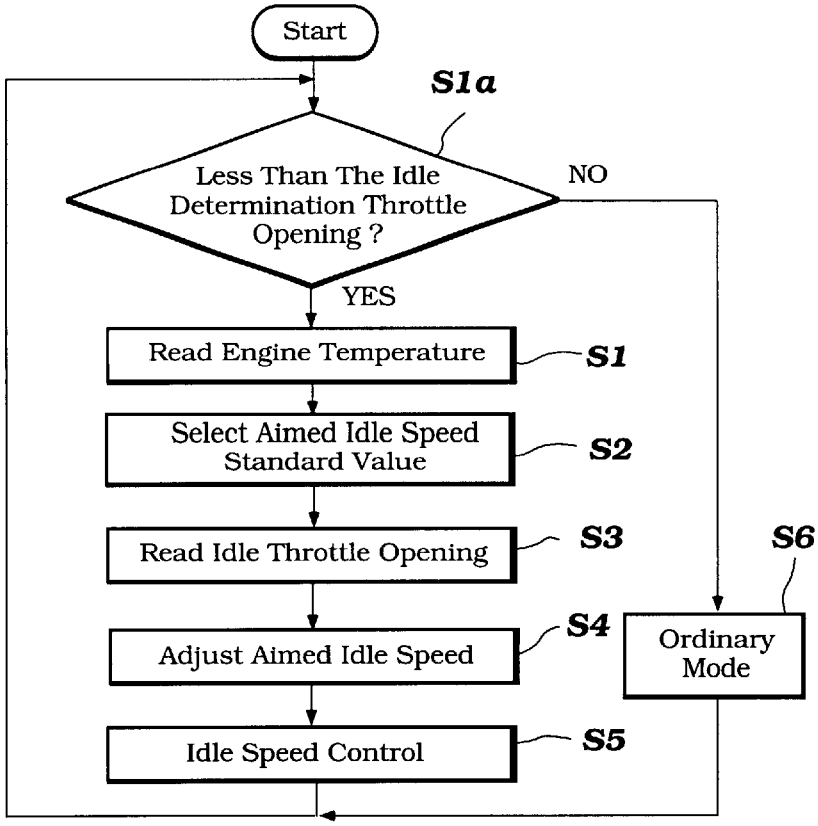
FIG. 7 is a flowchart showing a control routine for controlling engine operations under an idle speed.

Actually, the EMU 110 controls the idle speed with the adjusted idle speed when the opening of the throttle valves 174 is less than an idle determination opening. This entire control routine is illustrated in FIG. 7.

In this control routine, the program starts and moves to the step S1*a* to determine whether the opening of the throttle valves 174 is less than the idle determination opening at the step S1*a*. If this is true, the routine goes to the step S1 which has been already described in the control routine shown in FIG. 4 and performs the following steps S2 to S4 one after another to obtain the adjusted idle speed. Then, the routine goes to the step S5 to control the valve opening of the idle air adjusting unit 212 in a feedback control manner so that the actual idle engine speed sensed by the cranks haft angle position sensor 230 will be consistent with or approximate the aimed idle engine speed. If the opening of the throttle valves 174 is not less than the idle determination opening (step S1*a*), the routine goes to the step S6 to control the engine 32 in the ordinary mode. That is, the engine speed in the ordinary mode is controlled in proportion to the opening of the throttle valves 174.

The graph shown in FIG. 8 illustrates basically the same control map as shown in FIG. 6 but more in detail. The line (B) in the graph designates the idle determination opening of the throttle valves 174 that is used at the step S1*a*. If the throttle valve opening is selected at the preset initial opening (ThθA), i.e., 0.5 degrees at the engine temperature 40° C., but the actual opening is greater than the idle determination opening (B), the EMU 110 controls the engine 32 in the ordinary mode and thus the engine speed increases along the line (A) when the throttle valve opening increases. If the throttle valve opening is less than the idle determination opening (B), the EMU 110 controls the idle speed to be the speed (RevA), i.e., 700 rpm. That is, if the idle speed goes to 705 rpm, the EMU 110 immediately adjusts it back to the aimed idle speed 700 rpm. In the same manner, if the throttle valve opening is selected at another initial opening (ThθAa), i.e., 0.3 degrees, but the actual opening is greater than the idle determination opening (B), the EMU 110 controls the engine 32 in the ordinary mode and thus the engine speed increases along the line (Aa) when the throttle valve opening increases. If the throttle valve opening is less than the idle determination opening (B), the EMU 110 controls the idle speed to keep the speed (RevAa), i.e., 650 (=700−50) rpm. When another idle speed (RevAb), (RevAc) or (RevAd) is selected, EMU 110 controls the idle speed as well along the line (Ab), (Ac) or (Ad). Additionally, if the engine temperature is different, the lines (Aa), (Ab), (Ac), (Ad) will be offset to the right or left hand positions from the present line positions.

As described above, the EMU can change the aimed idle speed. Thus, the operator may operate the engine to obtain any idle speed that provides a desired trolling speed. In addition, any adjusting screws which are conventionally used are applicable in this embodiment to adjust the throttle valve opening. This contributes to cost reduction accordingly.

Figure 9:
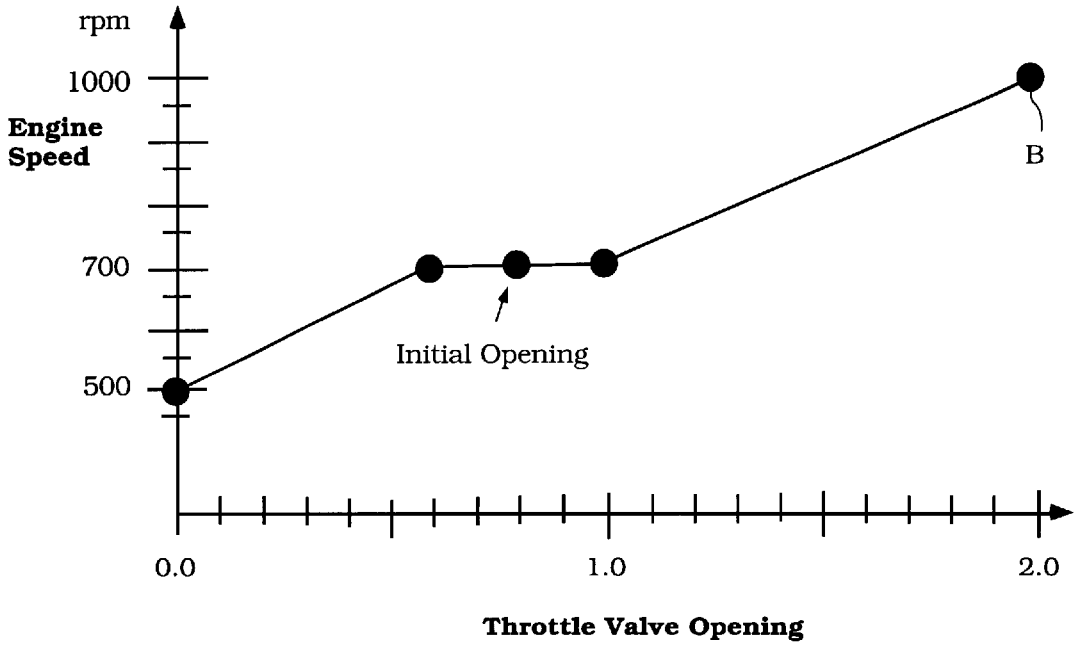
FIG. 9 is a map showing aimed idle engine speeds corresponding to selected throttle openings as a variation of the map shown in FIG. 6.

In the embodiment described above, the aimed idle speeds are discontinuously scattered in the control map as shown in FIGS. 6 and 8. However, they can be put continuously therein. FIG. 9 illustrate a variation of the embodiment in which the EMU 110 has this kind of control map. The idle speed in the map increases from 500 rpm at 0.0 degree to 700 rpm at 0.6 degrees and stays on this speed range until the throttle valve opening becomes 1.0 degree and then it increases to 1,000 rpm at 2.0 degrees. The point (B) corresponds to the line (B) that designates the idle determination opening. The reason why the idle speed stays at 700 rpm from the throttle opening 0.6 to 1.0 degrees is that the initial opening is given in this range as shown in FIG. 9. This is advantageous because no fluctuations in the idle speed may be expected around the initial opening and hence erroneous operations (i.e., adjustments to the adjustment screw) can be inhibited.

With reference back to FIG. 8, the idle determination opening (B) is fixed in this embodiment as described above. This means that the engine speeds (RevAa), (RevAb), (RevA), (RevAc), (RevAd) at the idle determination opening (B) for each respective idle throttle openings (ThθAa), (ThθAb), (ThθA), (ThθAc), (ThθAd), all differ from one another by ΔTa. Thus, for instance, if the idle throttle opening (ThθAb) is selected, the operator may have a feeling that something is wrong when the engine's operation is moved into the ordinary mode. On the other hand, if the idle throttle opening (ThθAd) is selected, the throttle opening occasionally may be exceeded because the difference ΔTa is quite small.

Figure 10:
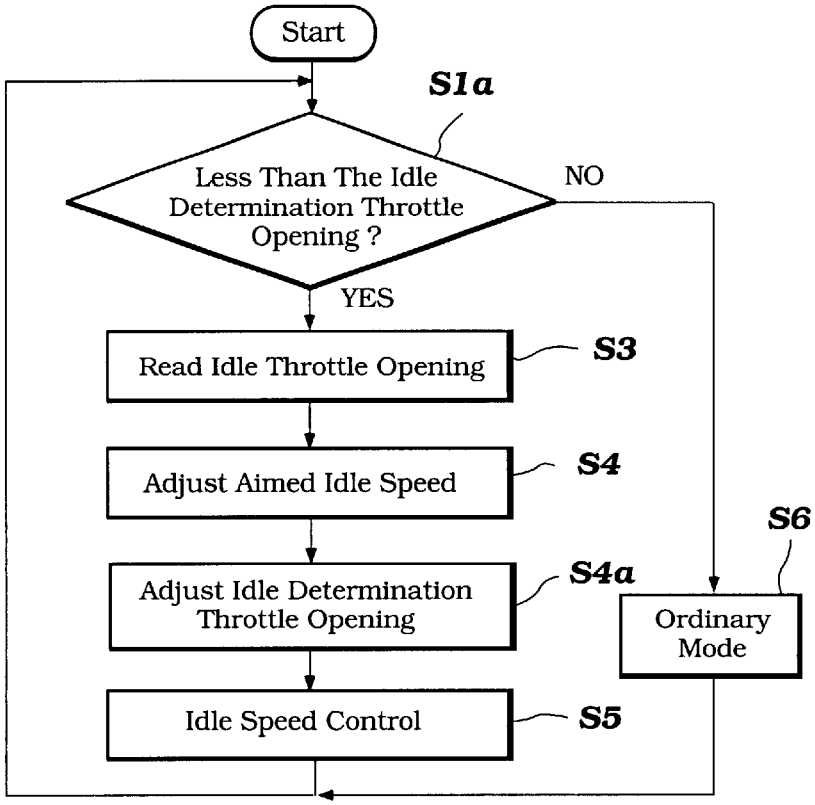
FIG. 10 is a flowchart showing a control routine for controlling engine operations under an idle speed in accordance with another embodiment of the present invention.
Figure 11:
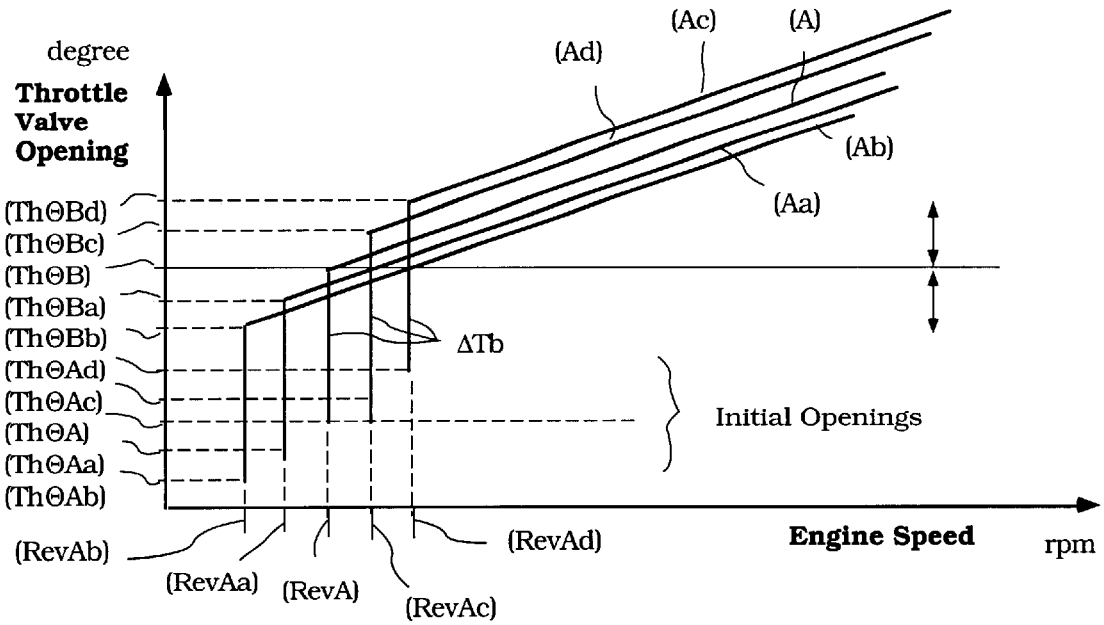
FIG. 11 is a graphical view showing relationships between aimed idle engine speeds and selected idle throttle openings that corresponds to the control routine shown in FIG. 10.

Another embodiment, which is shown in FIGS. 10 and 11, resolves this problem. As seen in FIG. 10, the step S4*a* is inserted between the step S4 and S5 in the control routine shown in FIG. 4. At this step S4*a*, the EMU 110 changes the idle determination throttle opening in response to the respective idle throttle openings. That is, idle determination throttle openings (ThθBa), (ThθBb), (B), (ThθBc), (ThθBd) are adjusted so that respective differences between the idle determination opening (ThθBa), (ThθBb), (B), (ThθBc), (ThθBd) and the idle throttle openings (RevAa), (RevAb), (RevA), (RevAc), (RevAd) are fixed to be ΔTb. Because of this improvement, the operator will not feel that something is wrong with changes to the initial opening of the throttle valve 174, and the throttle opening will not exceed the difference ΔTb.

In addition, the steps S1 and S2 are not included in this embodiment because the standard value of the aimed idle speed is fixed to one value corresponding to one fixed engine temperature. However, these steps S1, S2 are of course necessary if the aimed idle speeds are prepared in corresponding to various temperatures.

In the embodiments described above, the aimed idle speed is adjustable by changing the throttle valve opening. However, the aimed idle speed can be set directly in the EMU 110. For instance, as seen in FIG. 1, a variable resister 280 that can change the previously stored aimed idle speed as applicable. Otherwise, even an interface such as, for example, a keyboard, mouse or touch panel for a personal computer 282 is practicable to directly change the aimed idle speed. In the latter variation, the EMU 110 has an input connector to which the computer 282 can be connected.

Of course, the foregoing description is that of preferred embodiments of the invention, and various changes and modifications may be made without departing from the spirit and scope of the invention, as defined by the appended claims.

What is claimed is:

1. An internal combustion engine comprising a cylinder body defining at least one cylinder bore in which a piston reciprocates to rotate a crankcshaft, a cylinder head affixed to an end of the cylinder and defining a combustion chamber with the cylinder bore and the piston, an air induction system delivering an air charge to thle combustion chamber, the air induction system including a main passage having a throttle device therein and a bypass passage arranged to bypass the throttle device to supply an idle air charge to the combustion chamber when the throttle device is generally closed, the bypass passage having an flow regulator therein to regulate the idle air charge, a speed sensor to sense engine speed, a throttle opening sensor to sense the opening degree of the throttle device, and a controller connected to the flow regulator, to the speed sensor and to the throttle opening sensor, the controller being configured to control the flow regulator to reduce a difference between the engine speed sensed by the speed sensor and an aimed idle speed that is preset in the controller, the controller including an idle adjuster to adjust the preset aimed idle speed, and the idle adjuster being configured to change the aimed idle speed based upon a signal from the tlrottle opening sensor which is indicative of an opening degree of the throttle device at idle.

2. An internal combustion engine as set forth in claim 1, wherein the controller is additionally configured to determine whether the opening of the throttle device at idle varies from a preset opening, and to control the flow regulator in the bypass passage based upon the determination.

3. An internal combustion engine as set forth in claim 2, wherein the preset opening is a fixed value stored in memory of the controller.

4. An internal combustion engine as set forth in claim 3, wherein the throttle device includes an adjustment mechanism to adjust the opening of the throttle at idle, and the idle adjuster is configured to change the aimed idle speed based upon a difference between the preset openinig and an adjusted opening of the throttle device at idle.

5. An internal combustion engine as set forth in claim 4, wherein the engine includes an engine temperature sensor to sense engine temnperature, the sensor being connected to the controller, and the idle adjuster being configured to determine the aimed idle speed based on the preset opening and the sensed engine temperature.

6. An internal combustion engine as set forth in claim 4, wherein the aimed idle speed is a fixed value stored in memory of the controller.

7. An internal combustion engine as set forth in claim 4, wherein an idle determination opening for the throttle device is stored in the controller, and the controller is configured to determine whether the seused opening of the throttle device is less than the idle determination opening, and to control the flow regulator to maintain the aimed idle speed established by the idle adjuster if the sensed opening is less than the idle determination opening.

8. An internal combustion engine as set forth in claim 7, wherein the idle determination opening is constant over a range of differences between the preset opening and the adjusted opening of the throttle device at idle.

9. An internal combustion engine as set forth in claim 7, wherein the idle determination opening varies over a range of differences between the preset opening and the adjusted opening of the throttle device at idle.

10. An internal combustion engine as set forth in claim 1, wherein the engine powers a marine propulsion device.

11. An internal combustion engine as set forth in claim 1, wherein an idle determination opening for the throttle device is stored in the controller, and the controller is further configured to determine whether the sensed opening of the throttle device is less than the idle determination opening and to control the flow regulator to maintain the aimed idle speed established by the idle adjuster if the sensed opening is less than the idle determination opening.

12. An internal combustion engine as set forth in claim 2, wherein the engine includes an engine temperature sensor to sense engine temperature, the sensor being connected to the controller and the idle adjuster being configured to determine the aimed idle speed based on the preset opening and the sensed engine temperature.

13. An internal combustion engine as set forth in claim 2, wherein the aimed idle speed is a fixed value stored in memory of the controller.

14. An internal combustion engine as set forth in claim 7, wherein the idle determiiation opening coincides with the preset opening.

15. An internal combustion engine comprising a cylinder body defining at least one cylinder bore in which a piston reciprocates to rotate a cranks haft, a cylinder head affixed to an end of the cylinder and defining a combustion chamber with the cylinder bore and the piston, an air induction system delivering an air charge to the combustion chamber, the air induction system including a main passage having a throttle device therein and a bypass passage, arranged to bypass the throttle device to supply an idle air charge to the combustion chamber when the throttle device is generally closed, the bypass passage having an flow regulator therein to regulate the idle air charge, a speed sensor to sense engine speed, a throttle opening sensor to sense the opening degree of the throttle device, and a controller connected to the flow regulator, to the speed sensor and the throttle opening sensor, the controller being configured to control the flow regulator to reduce a difference between the engine speed sensed by the speed sensor and an aimed idle speed that is preset in the controller, the controller including an idle adjuster to adjust the preset aimed idle speed, the idle adjuster including an adjustment mechanism that is operable outside of the controller to directly change the aimed idle speed, the controller storing an idle determination opening for the throttle device, the controller being further configured to determine whether the sensed opening of the throttle device is less than the idle determination opening, and to control the flow regulator to maintain the aimed idle speed established by the idle adjuster if the sensed opening is less than the idle determination opening, and the idle determination opening being constant over a range of differences between the present opening and the adjusted opening of the throttle device at idle.

16. An internal combustion engine comprising a cylinder body defining at least one cylinder bore in which a piston reciprocates to rotate a cranks haft, a cylinder head affixed to an end of the cylinder and defining a combustion chamber with the cylinder bore and the piston, an air induction system delivering an air charge to the combustion chamber, the air induction system including a main passage having a throttle device therein and a bypass passage arranged to bypass the throttle device to supply an idle air charge to the combustion chamber when the throttle device is generally closed, the bypass passage having an flow regulator therein to regulate the idle air charge, a speed sensor to sense engine speed, a throttle opening sensor to sense the opening degree of the throttle device, and a controller connected to the flow regulator, to the speed sensor and the throttle opening sensor, the controller being configured to control the flow regulator to reduce a difference between the engine speed sensed by the speed sensor and an aimed idle speed that is preset in the controller, the controller including an idle adjuster to adjust the preset aimed idle speeds the idle adjuster including an adjustment mechanism that is operable outside of the controller to directly change the aimed idle speed, the controller storing an idle determination opening for the throttle device, the controller being further configured to determine whether the sensed opening of the throttle device is less than the idle determination opening, and to control the flow regulator to maintain the aimed idle speed established by the idle adjuster if the sensed opening is less than the idle determination opening, and the idle determination opening varying over a range of differences between the preset opening and the adjusted opening of the throttle device at idle.

17. An idle speed control system for an internal combustion engine having a combustion chamber, an air induction passage delivering an air charge to the combustion chamber, a throttle device for admitting the air charge to pass through the induction passage, a bypass passage bypassing the throttle device under an idle condition of the engine, the bypass passage including means for adjusting an amount of the w charge passing therethrough, the idle speed control system comprising means for sensing an engine speed, means for controlling the adjusting means to reduce a difference between an actual engine speed sensed by the speed sensing means and an aimed idle speed preset in the control system, means for changing the aimed idle speed, and means for sensing the opening of the throttle device, the changing means changing the aimed idle speed based upon a signal sensed by the opening sensing means.

18. An idle speed control system as set forth in claim 17, wherein the control system additionally includes means for determining whether the opening of the throttle device is less than a preset opening, and the control system is configured to control the adjusting means based upon a signal from the determining means indicating that the opening of the throttle device is less than the preset opening.

19. An idle speed control system as set forth in claim 18, wherein the preset opening is fixed.

20. An idle speed control system as set forth in claim 18, wherein the preset opening is changeable in response to the opening adjusted by an adjustment mechanism.

21. A method of operating an internal combustion engine having a combustion chamber, an air induction passage delivering an air charge to the combustion chamber and a throttle device disposed therein, a bypass passage bypassing the throttle device under the idle condition of the engine, the bypass passage including a flow regulator to govern an amount of the air charge passing therethrough, the method comprising establishing an aimed idle speed, sensing an actual engine speed, and controlling the flow regulator to reduce a difference between the actual engine speed and the aimed idle speed, adjusting an opening of the throttle device at idle, sensing the opening of the throttle device at idle, determining a difference between a preset opening and the sensed opening of the tlrottle device at idle, and adjusting the aimed idle speed based upon the difference between the preset and sensed openings of the throttle device.

22. A method as set forth in claim 21 additionally comprising sensing an engine temperature, and wherein establishing the aimed idle speed is based upon the sensed engine temperature.

23. A method as set forth in claim 21, wherein establishing the aimed idle speed involves retrieving the aimed idle speed from memory.

24. A method as set forth in claim 21 additionally comprising determining whether the opening of the throttle device is less than an idle determination opening, and controlling the flow regulator when the opening of the throttle device is less than the idle determination opening.

25. A method as set forth in claim 24 additionally comprising changing the idle determination opening in response to the opening of the throttle device at idle.

26. A method as set forth in claim 21, wherein changing the aimed idle speed involves connecting an external computer to an interface port of the controller and down-loading data to the controller.

27. A method as set forth in claim 26 additionally comprising determining whether the opening of the throttle device is less than an idle determination opening, and controlling the flow regulator when the opening of the throttle device is less than the idle determination opening.

28. A method as set forth in claim 27 additionally comprising changing the idle determination opening in response to the opening of the throttle device at idle.

29. An internal combustion engine as set forth in claim 11, wherein the idle determination opening is constant.

30. An internal combustion engine as set forth in 11, wherein the idle determination opening is changeable.

* * * * *

UNITED STATES PATENT AND TRADEMARK OFFICE

CERTIFICATE OF CORRECTION

PATENT NO. : 6,415,766 B1
DATED : July 9, 2002
INVENTOR(S) : Kanno et al.

It is certified that error appears in the above-identified patent and that said Letters Patent is hereby corrected as shown below:

Column 11,
Line 24, change “crankcshaft”, to -- crankshaft --
Line 27, change “thle”, to -- the --
Line 42, change “tlrottle”, to -- throttle --
Line 61, change “temnperature”, to -- temperature --

Column 12,
Line 4, change “seused”, to -- sensed --
Line 37, change “determiiation”, to -- determination --
Line 41, change “cranks haft”, to -- crankshaft --

Column 13,
Line 6, change “cranks haft”, to -- crankshaft --

Column 14,
Line 21, change “tlrottle”, to -- throttle --

Signed and Sealed this

Sixteenth Day of March, 2004

JON W. DUDAS
*Acting Director of the United States Patent and Trademark Office*